US006732899B2

(12) United States Patent
Franks

(10) Patent No.: US 6,732,899 B2
(45) Date of Patent: May 11, 2004

(54) SYSTEM FOR DISPENSING PLASTIC FASTENERS

(75) Inventor: John R. Franks, Hopkinton, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/116,451

(22) Filed: Apr. 4, 2002

(65) Prior Publication Data

US 2003/0189078 A1 Oct. 9, 2003

(51) Int. Cl.[7] ..... B25C 7/00

(52) U.S. Cl. ..... 227/107; 227/154; 83/935; 83/941

(58) Field of Search ..... 227/67, 68, 69, 227/70, 71, 76, 140, 107, 154; 83/936, 939, 941

(56) References Cited

U.S. PATENT DOCUMENTS

| | | | | | |
|---|---|---|---|---|---|
| 4,039,078 | A | | 8/1977 | Bone | |
| 4,288,017 | A | * | 9/1981 | Russell | 227/67 |
| 4,315,587 | A | * | 2/1982 | Ritter et al. | 227/67 |
| 4,323,183 | A | * | 4/1982 | Duchin | 227/3 |
| 4,627,562 | A | * | 12/1986 | Bone | 227/67 |
| 4,671,149 | A | * | 6/1987 | Makabe et al. | 83/30 |
| 4,718,158 | A | * | 1/1988 | Block | 29/432 |
| 4,877,172 | A | * | 10/1989 | Franklin et al. | 227/69 |
| 4,882,961 | A | * | 11/1989 | Zabinski et al. | 83/177 |
| 4,889,272 | A | * | 12/1989 | Kunreuther | 227/4 |
| 5,092,829 | A | * | 3/1992 | Gerber | 493/351 |
| 5,169,047 | A | * | 12/1992 | Endres et al. | 227/27 |
| 5,433,366 | A | | 7/1995 | Deschenes et al. | |
| 5,598,948 | A | * | 2/1997 | Rizer | 221/198 |
| 5,615,816 | A | | 4/1997 | Deschenes et al. | |

* cited by examiner

*Primary Examiner*—Rinaldi I. Rada
*Assistant Examiner*—Gloria R Weeks
(74) *Attorney, Agent, or Firm*—Kriegsman & Kriegsman

(57) ABSTRACT

A system for dispensing a fastener from a reel of fastener stock to couple together two or more objects comprises a module for dispensing the plastic fastener and a mounting stand on which the module is mounted. The mounting stand includes a vertical leg, a first horizontal leg, a second horizontal leg and a pair of spaced apart, parallel shafts extending between the first and second horizontal legs. A linear ball bearing is slidably mounted onto each of the shafts. A bearing mount is fixedly mounted onto each of the linear ball bearings. A bracket is fixedly mounted onto the pair of bearing mounts. The module is mounted onto the bracket and is capable of linear displacement. Upper and lower adjustable collars are fixed in place on the pair of shafts to limit the range of the linear displacement of the module.

21 Claims, 4 Drawing Sheets

SYSTEM FOR DISPENSING PLASTIC FASTENERS

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

Either manually or with the aid of specifically designed devices, individual fasteners may be dispensed from the ladder stock to couple buttons to fabric, merchandising tags to articles of commerce, or, in general, any two desired articles. In those instances where the dispensing device has dual needles, the attachments severed from the stock can be used like staples to secure objects and items.

Specifically designed devices for dispensing individual plastic fasteners are well known in the art. Plastic fastener dispensing devices are commonly used to sever individual plastic fasteners from continuously connected ladder stock and to attach the severed individual plastic fasteners to items.

In commonly assigned U.S. Pat. No. 5,615,816, which is incorporated herein by reference, there is disclosed an apparatus for dispensing attachments from continuously connected ladder stock of the type comprising a pair of plastic side members coupled together by a plurality of plastic cross links. The apparatus includes a mount, a support movably mounted on the mount, and a pair of carrier blocks mounted on the support. A needle block is mounted on each carrier block and a hollow, slotted needle is mounted on each needle block. A feed mechanism including a pair of feed wheels, is mounted on the support for advancing the ladder stock into the hollow slotted needles and a pair feed tracks, one for each hollow slotted needle, are provided through which the ladder stock passes from the feed wheels into the pair of hollow slotted needles. A pair of knives are provided for severing an attachment from the ladder stock, and a pair of ejector rods are provided for ejecting the severed attachment through the hollow slotted needles. The carrier blocks are disposed parallel to each other and movable sideways relative to each other so that the spacing between the hollow slotted needles can be changed for different applications. The feed wheels are disposed parallel to each other and are capable of being moved sideways relative to each other so that their spacing can be changed to accommodate different widths of ladder stock. In order to provide a path for the ladder stock form the feed wheels to the hollow slotted needles for different feed wheel spacings and/or needle spacings, each feed track assembly includes a pivotally mounted section.

The apparatus disclosed in U.S. Pat. No. 5,615,816 is well known in the art and is commonly referred to in the art simply as a variable needle system (VNS), or module.

Variable needle systems of the type described in U.S. Pat. No. 5,616,816 are commonly used in the art to secure a product for sale, such as a toy, hardware item or houseware item, onto a display card using one or more plastic fasteners. As can be appreciated, when used to secure a product for sale onto a display card, plastic fasteners are commonly referred to as elastic staples in the art.

It should be noted that the use of a variable needle system of the type described in U.S. Pat. No. 5,616,816 to secure a product of sale onto a display card using one or more elastic staples provides numerous advantages. Specifically, the capability of such a variable needle system to continuously dispense elastic staples from a roll of fastener stock increases the productivity in which an operator is able to secure products for sale onto associated display cards, which is highly desirable. Accordingly, variable needle systems of the type described in U.S. Pat. No. 5,616,816 are commonly used on assembly lines for packaging products.

It should also be noted that the use of elastic staples to secure a product of sale onto a display card provides numerous advantages.

As an example, the particular construction of an elastic staple creates aesthetic benefits which are highly desirable. Specifically, the use of elastic staples enables the product for sale to be mounted onto a display card, thereby enabling the product to be presented to the potential customer in an ideal packaging to see, feel and manipulate the product at the point of purchase. Furthermore, it has been found that the elastic staple is barely visible when securing a product for sale onto its associated display card.

As another example, the elasticity of the staple allows for the fastener to be used in a wide range of applications and in conjunction with a variety of differently sized products, which is highly desirable.

As another example, the elasticity of the staple allows for the fastener to conform tightly against the product for sale, thereby creating a strong and durable attachment of the product for sale onto its associated display card, which is highly desirable. As a result, the product remains securely fastened onto the display card until after purchase.

Although well known and widely used in the art for securing products for sale onto display cards, variable needle systems of the type disclosed in U.S. Pat. No. 5,615,816 suffer from a few notable drawbacks.

As a first drawback, the variable needle system disclosed in U.S. Pat. No. 5,615,816 is often fixedly mounted onto a support structure. Accordingly, in use, the operator is required to manually urge the items to be coupled up against the pair of needles in such a manner so that the pair of needles penetrates through the items. As a consequence, it has been found that the user is at risk of inadvertently contacting the sharpened end of the needles, which is highly undesirable.

As a second drawback, the variable needle system disclosed in U.S. Pat. No. 5,615,816 is constructed so that the operator can insert the needles into and through the items to be coupled at variable depths. Specifically, the operator is unable to regulate the degree of insertion of the needles through the items. As a result, if the needles are inserted too far through the items, the fastener can become overstretched and, as a result, will break, which is highly undesirable. Furthermore, if the needles are not inserted far enough through the items, the fastener is unable to penetrate through the items, thereby precluding proper coupling, which is highly undesirable.

Accordingly, in commonly assigned and presently pending patent application Ser. No. 09/867,264 to Steven E. Flannery et al. (hereinafter referred to as the '264 patent application), there is disclosed a system for dispensing a fastener from a reel of fastener stock so as to secure a product onto a display card. The system includes a module for dispensing the fastener, a counterbalance for supporting the module, a mounting stand for supporting the counterbalance, a reel holder for supporting the reel of fastener stock and an anvil for supporting the product and display card.

Although well-known and widely used in commerce, the system disclosed in the '264 patent application suffers from a pair of notable drawbacks.

As a first drawback, the system disclosed in the '264 patent application allows for the free and unlimited movement of the module in any direction. However, the system disclosed in the '264 patent application is traditionally used in an assembly line environment which only requires linear, vertical (i.e., straight up and down) displacement of the module. As a result, the operator of the module often introduces non-vertical displacement forces onto the module. The application of non-vertical displacement forces onto the module reduces the efficiency of the movements which the operator is required to undertake, which is highly undesirable. In addition, the application of non-vertical displacement forces onto the module introduces inconsistencies in the position where the operator inserts the needles of the module through the items to be coupled together, which is highly undesirable.

As a second drawback, the system disclosed in the '264 patent application allows for the unlimited displacement of the module in the downward direction. As can be appreciated, displacing the module too far in the downward direction can potentially damage the objects to be coupled and/or the module needles, which is highly undesirable.

SUMMARY OF THE INVENTION

It is an object of the present invention to provide a new and improved system for dispensing a plastic fastener from a reel of fastener stock to couple together two or more items.

It is another object of the present invention to provide a system as described above which includes a module for dispensing the plastic fastener from the reel of fastener stock.

It is yet another object of the present invention to provide a system as described above which includes a stand onto which the module is mounted.

It is still another object of the present invention to provide a system as described above which enables an operator to displace the module relative to the stand.

It is yet still another object of the present invention to provide a system as described above which limits the range of motion by which an operator is able to displace the module relative to the stand.

Accordingly, there is provided a system for dispensing a plastic fastener from a reel of fastener stock to couple together two or more objects, said system comprising a module for dispensing the plastic fastener from the reel of fastener stock to couple together the two or more objects, and a mounting stand on which said module is mounted, said mounting stand limiting said module to linear displacement.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
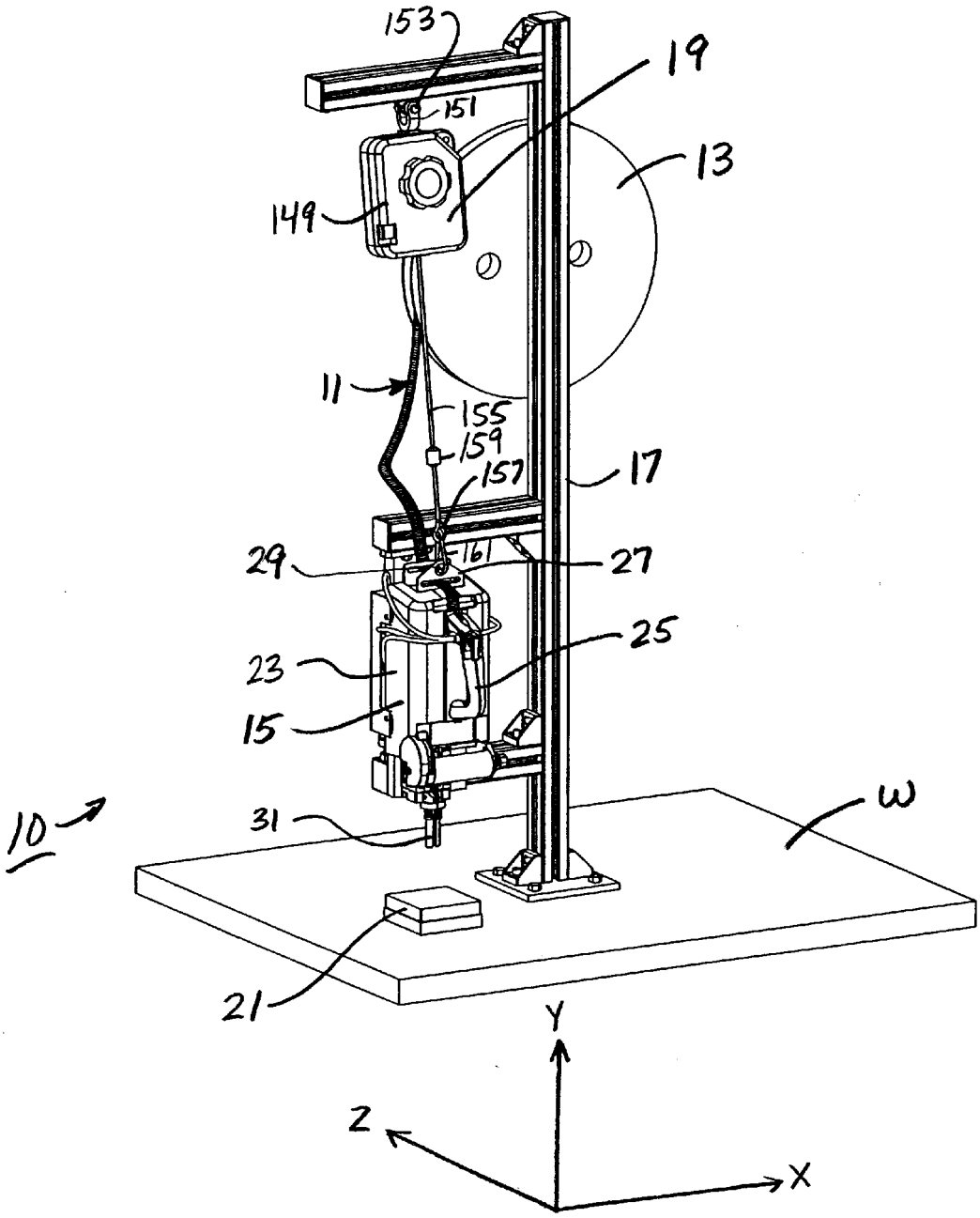
FIG. 1 is a front perspective view of a system for dispensing a plastic fastener from a reel of fastener stock to couple together two or more objects, said system being constructed according to the teachings of the present invention, said system being shown mounted onto a workstation surface, said system being shown with a supply of continuously connected ladder stock fed thereinto, said system also being shown in relation to an X-axis, a Y-axis and a Z-axis.

Referring now to FIG. 1, there is shown a system constructed according to the teachings of the present invention, the system being identified generally by reference numeral 10. As will be described further in detail below, system 10 is designed for use in dispensing individual plastic fasteners from a supply of continuously connected ladder stock 11.

As such, system 10 can be used in an automated packaging line to couple together two or more objects. Specifically, system 10 may be used, for example, to secure a product for sale, such as a toy, hardware item or houseware item, onto to a cardboard display card using one or more plastic fasteners.

Supply of continuously connected ladder stock 11 represents any well known continuous supply of plastic fasteners. For example, ladder stock 11 may be of the type described in U.S. Pat. No. 5,615,816 to Charles L. Deschenes et al. The continuously connected ladder stock described in U.S. Pat. No. 5,615,816 is preferably made of plastic and comprises a pair of side members which are interconnected by a plurality of cross links. A fastener which is obtained from the ladder stock described in U.S. Pat. No. 5,615,816 is commonly referred to as an elastic staple in the art and comprises a pair of end bars which are interconnected by a thin filament.

It should be noted that ladder stock 11 is preferably wound onto a reel 13, reel 13 being sized and shaped to hold a supply of ladder stock 11 which includes approximately 10,000 fasteners. As such, the high volume reel 13 of fasteners allows for the continuous operation of system 10, which is highly desirable.

System 10 comprises a module 15 for dispensing individual plastic fasteners, a mounting stand 17 affixed to a workstation W, a counterbalance 19 affixed to mounting stand 17 for supporting module 15, and an anvil 21 mounted onto workstation W for supporting the items to be coupled together with the one or more individual plastic fasteners.

Module 15 represents any well known device for dispensing plastic fasteners from a reel of fastener stock. For example, module 15 may be a variable needle system (VNS) of the type described in U.S. Pat. No. 5,616,816 to Charles L. Deschenes, which is incorporated herein by reference. As another example, module 15 may be of the type described in commonly assigned and presently pending patent application Ser. No. 09/867,264 to Steven E. Flannery et al.

Preferably, module 15 comprises a housing 23 which defines an internal cavity. A handle 25 is fixedly mounted onto the exterior of housing 23 in order to provide the operator with means for moving module 15. A U-shaped bracket 27 is fixedly mounted onto housing 23 and is shaped to define a clip opening, or tether ring, 29 onto which counterbalance 19 can be clipped.

Module 15 also preferably includes at least one hollowed needle 31. At least one hollowed needle 31 includes a spoon-shaped sharpened tip which can easily penetrate through the items to be coupled together and through which an end bar of an individual plastic fastener may pass during the dispensing of said fastener from module 15.

As noted above, the particular construction of module 15 does not serve as a principal feature of the present invention. As a result, it is to be understood that other known types of devices for dispensing individual plastic fasteners could be used in system 10 in place of module 15 without departing from the spirit of the present invention.

Mounting stand 17 is installed onto workstation W. As will be described further below, mounting stand 17 serves to: (1) limit module 15 to linear displacement within a defined range; (2) support counterbalance 19; and (3) support reel 13 of plastic fasteners 11. It should be noted that the particular construction and functionality of mounting stand 17 serves as the principal novel features of the present invention.

Figure 2:
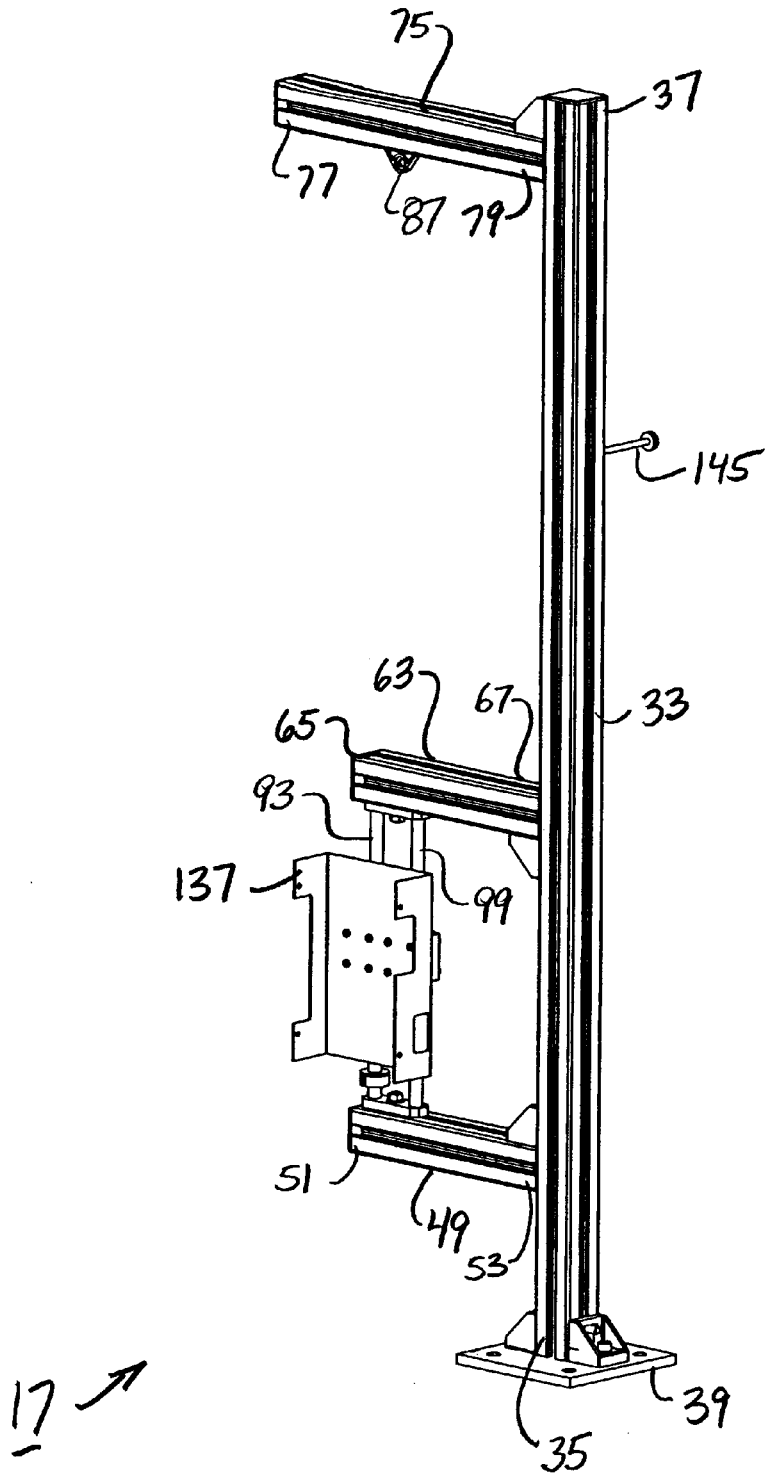
FIG. 2 is a front perspective view of the mounting stand shown in FIG. 1.
Figure 3:
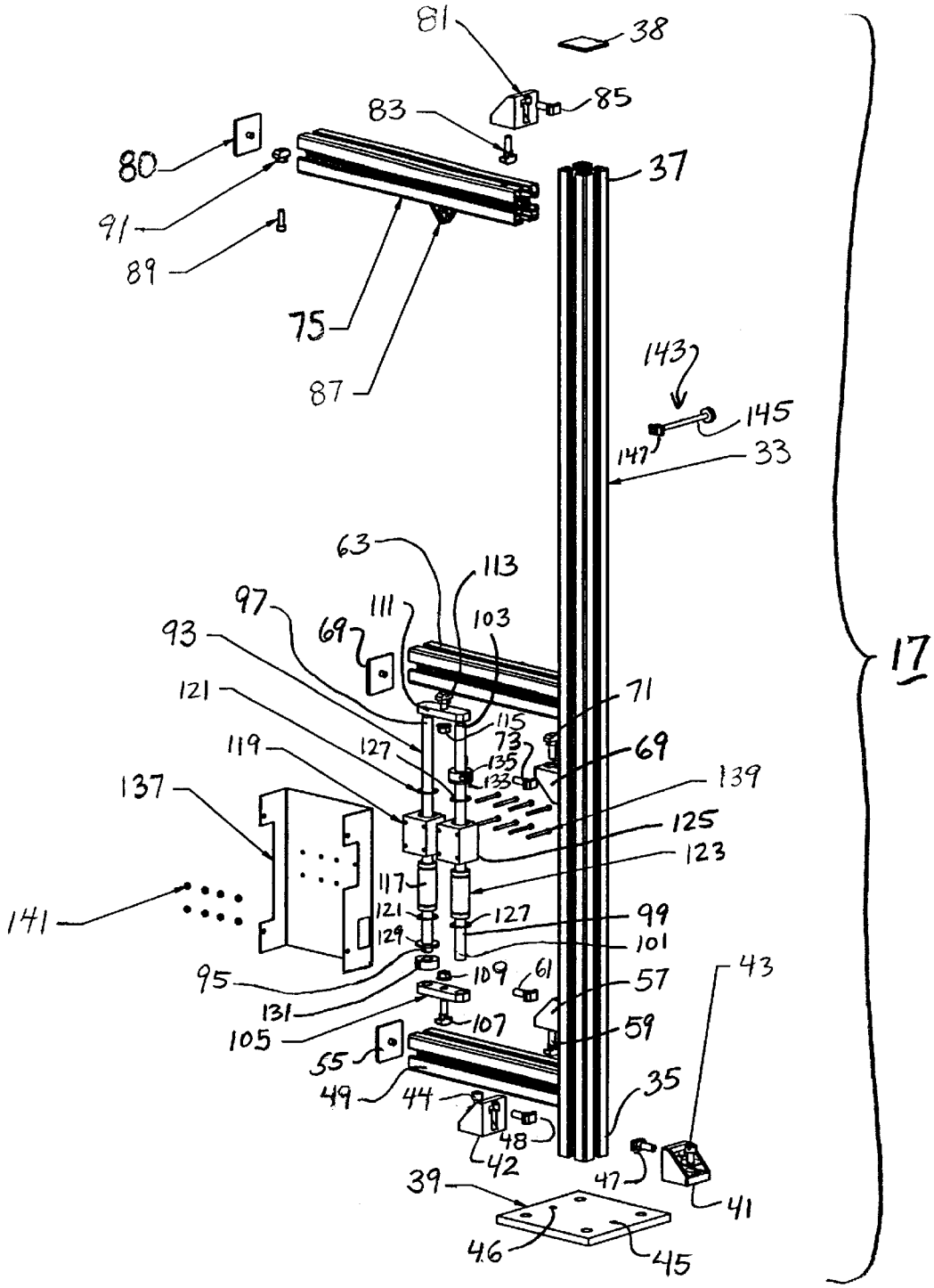
FIG. 3 is a front, exploded, perspective view of the mounting stand shown in FIG. 1.

As seen most clearly in FIGS. 2 and 3, mounting stand 17 comprises an elongated vertical leg 33 which includes a first end 35 and a second end 37. An end cap 38 is press-fit mounted onto second end 37 of vertical leg 33.

First end 35 of vertical leg 33 is affixed to a flat, metallic base plate 39. First end 35 of vertical leg 33 is fixedly secured in position against the top surface of base plate 39 using a plurality of conventional fastening devices. Specifically, first and second gussets 41 and 42 are disposed in contact against opposite sides of first end 35 of vertical leg 33 and the top surface of base plate 39. A first screw 43 is disposed through gusset 41 and into engagement with a threaded bore 45 formed in the top surface of base plate 39, thereby fixedly securing gusset 41 onto base plate 39. Similarly, a second screw 44 is disposed through gusset 42 and into engagement with a threaded bore 46 formed in the top surface of base plate 39, thereby fixedly securing gusset 42 onto base plate 39. A first T-bolt and nut fastener assembly 47 is disposed through gusset 41 and first end 35 of vertical leg 33, thereby fixedly securing gusset 41 onto vertical leg 33. Similarly, a second T-bolt and nut fastener assembly 48 is disposed through gusset 42 and first end 35 of vertical leg 33, thereby fixedly securing gusset 42 onto vertical leg 33.

Mounting stand 17 also comprises a first horizontal leg 49 which includes a first end 51 and a second end 53. An end cap 55 is press-fit mounted onto first end 51 of first horizontal leg 49.

Second end 53 of first horizontal leg 49 is affixed to vertical leg 33 proximate first end 35, horizontal leg 49 being coupled to vertical leg 33 in such a manner so that first horizontal leg 49 extends generally at a right angle relative to vertical leg 33. Second end 53 of horizontal leg 49 is fixedly secured to vertical leg 33 using a plurality of conventional fastening devices. Specifically, a gusset 57 is disposed in contact with second end 53 of first horizontal leg 49 and vertical leg 33. A first T-bolt and nut fastener assembly 59 is disposed through first horizontal leg 49 and gusset 57, thereby fixedly securing gusset 57 onto first horizontal leg 49. Similarly, a second T-bolt and nut fastener assembly 61 is disposed through vertical leg 33 and gusset 57, thereby fixedly securing gusset 57 onto vertical leg 33.

Mounting stand 17 additionally comprises a second horizontal leg 63 which includes a first end 65 and a second end 67. An end cap 68 is press-fit mounted onto first end 65 of second horizontal leg 63.

Second end 67 of second horizontal leg 63 is affixed to vertical leg 33 at the approximate midpoint between first end 35 and second end 37, horizontal leg 63 being coupled to vertical leg 33 in such a manner so that second horizontal leg 63 extends generally at a right angle relative to vertical leg 33. Second end 67 of horizontal leg 63 is fixedly secured to vertical leg 33 using a plurality of conventional fastening devices. Specifically, a gusset 69 is disposed in contact with second end 67 of second horizontal leg 63 and vertical leg 33. A first T-bolt and nut fastener assembly 71 is disposed through second horizontal leg 63 and gusset 69, thereby fixedly securing gusset 69 onto second horizontal leg 63. Similarly, a second T-bolt and nut fastener assembly 73 is disposed through vertical leg 33 and gusset 69, thereby fixedly securing gusset 69 onto vertical leg 33.

Mounting stand 17 further comprises a third horizontal leg 75 which includes a first end 77 and a second end 79. An end cap 80 is press-fit mounted onto first end 77 of third horizontal leg 75.

Second end 79 of third horizontal leg 75 is affixed to vertical leg 33 proximate second end 37, horizontal leg 75 being coupled to vertical leg 33 in such a manner so that third horizontal leg 75 extends generally at a right angle relative to vertical leg 33. Second end 79 of horizontal leg 75 is fixedly secured to vertical leg 33 using a plurality of conventional fastening devices. Specifically, a gusset 81 is disposed in contact with second end 79 of third horizontal leg 75 and vertical leg 33. A first T-bolt and nut fastener assembly 83 is disposed through third horizontal leg 75 and gusset 81, thereby fixedly securing gusset 81 onto third horizontal leg 75. Similarly, a second T-bolt and nut fastener assembly 85 is disposed through vertical leg 33 and gusset 81, thereby fixedly securing gusset 81 onto vertical leg 33.

A hanger, or ring, 87 is slidably mounted onto third horizontal leg 75. Hanger 87 is fixedly secured in place onto horizontal leg 75 using conventional fastening devices. Specifically, a bolt 89 is disposed through hanger 87 and third horizontal leg 75. A nut 91 is mounted onto the free end of bolt 89 and is tightened, thereby fixedly securing hanger 87 in place on leg 75. As will be described further below, counterbalance 19 is coupled onto hanger 87.

A first elongated shaft 93 extends orthogonally between first horizontal leg 49 and second horizontal leg 63. First elongated shaft 93 is in the form of an elongated cylindrical post and includes a first end 95 and a second end 97. Similarly, a second elongated shaft 99 extends orthogonally between first horizontal leg 49 and second horizontal leg 63. Second elongated shaft 99 is in the form of an elongated cylindrical post and includes a first end 101 and a second end 103. As will be described further in detail below, shafts 93 and 99 define the linear path which module 15 is capable of traveling.

First end 95 of first elongated shaft 93 and first end 101 of second elongated shaft 99 are sized and shaped to fittingly protrude into corresponding holes formed in a rod block 105. In turn, rod block 105 is disposed against the top surface of first horizontal leg 49 proximate first end 51. Rod block 105 is fixedly secured in place onto horizontal leg 49 using conventional fastening devices. Specifically, a bolt 107 is disposed through first horizontal leg 49 and rod block 105. A nut 109 is mounted onto the free end of bolt 107 and is tightened, thereby securing rod block 105 onto leg 49.

Similarly, second end 97 of first elongated shaft 93 and second end 103 of second elongated shaft 99 are sized and shaped to fittingly protrude into corresponding holes formed in a rod block 111. In turn, rod block 111 is disposed against the bottom surface of second horizontal leg 63 proximate first end 65. Rod block 111 is fixedly secured in place onto horizontal leg 63 using conventional fastening devices. Specifically, a bolt 113 is disposed through second horizontal leg 63 and rod block 111. A nut 115 is mounted onto the free end of bolt 113 and is tightened, thereby securing rod block 111 onto leg 63. As such, first and second shafts 93 and 99 are disposed in a parallel, spaced apart relation, shafts 93 and 99 posts extending generally orthogonally between first and second horizontal legs 49 and 63 and in parallel with vertical leg 33.

A first linear ball bearing 117 is slidably mounted onto first shaft 93 and is capable of displacement along the longitudinal axis of first shaft 93. A first bearing mount 119 is telescopingly mounted over first linear ball bearing 117. A pair of retaining rings 121 are also telescopingly mounted over first linear ball bearing 117 on opposite sides of bearing mount 119. Retaining rings 121 are sized and shaped to align and engage within corresponding grooves formed in linear ball bearing 117 so as to securely retain bearing mount 119 in place over linear ball bearing 117.

Similarly, a second linear ball bearing 123 is slidably mounted onto second shaft 99 and is capable of displacement along the longitudinal axis of second shaft 99. A second bearing mount 125 is telescopingly mounted over second linear ball bearing 123. A pair of retaining rings 127 are also telescopingly mounted over second linear ball bearing 123 on opposite sides of bearing mount 125. Retaining rings 127 are sized and shaped to align and engage within corresponding grooves formed in linear ball bearing 123 so as to securely retain bearing mount 125 in place over linear ball bearing 123.

A first rubber washer 129 is slidably mounted onto first shaft 93 between linear ball bearing 117 and rod block 105, washer 129 being capable of displacement along the longitudinal axis of first shaft 93. In addition, a first adjustable collar 131 is slidably mounted onto first shaft 93 between rubber washer 129 and rod block 105, collar 131 being capable of displacement along the longitudinal axis of first shaft 93. First adjustable collar 131 is adapted to be tightened, thereby reducing the diameter of its central opening. It should be noted that considerable tightening of first collar 131 fixes the position of collar 131 along shaft 93. Accordingly, together washer 129 and collar 131 serve as a stop for limiting the downward displacement of module 15, as will be described further below.

Similarly, a second rubber washer 133 is slidably mounted onto second shaft 99 between linear ball bearing 123 and rod block 111, washer 133 being capable of displacement along the longitudinal axis of second shaft 99. In addition, a second adjustable collar 135 is slidably mounted onto second shaft 99 between rubber washer 133 and rod block 111, collar 135 being capable of displacement along the longitudinal axis of second shaft 99. Second adjustable collar 135 is adapted to be tightened, thereby reducing the diameter of its central opening. It should be noted that considerable tightening of second collar 135 fixes the position of collar 135 along shaft 99. Accordingly, together washer 133 and collar 135 serve as a stop for limiting the upward displacement of module 15, as will be described further in detail below.

A bracket 137 for retaining module 15 is mounted onto bearing mounts 119 and 125. Bracket 137 is preferably constructed of sheet metal and is generally U-shaped in lateral cross-section. A plurality of bolts 139 are disposed through holes formed in mounts 119 and 125 and bracket 137. A corresponding nut 141 is threadingly mounted onto each bolt 139 so as to securely retain bracket 137 onto bearing mounts 119 and 125. As noted above, bracket 137 is sized and shaped to retain module 15, wherein a plurality of screws are disposed through bracket 137 and into module 15 to secure module 15 onto bracket 137.

A reel holder assembly 143 is affixed onto vertical leg 33 and serves to support reel 13 of fastener stock 11. Reel holder assembly 143 comprises a reel holder 145 which extends orthogonally away from vertical leg 33. Reel holder 145 is generally in the shape of an elongated pin and is secured in place on vertical leg 33 by a nut 147. The free end of reel holder 145 is sized and shaped to extend horizontally through a central opening formed in reel 13, thereby enabling reel holder 145 to support reel 13 of fastener stock 11 but enabling reel 13 to rotate on reel holder 145 without interference.

As seen most clearly in FIG. 1, counterbalance 19 is affixed onto mounting stand 17 and serves to support module 15. Counterbalance 19 includes a box-shaped housing 149 and a U-shaped bracket 151 affixed onto housing 149, U-shaped bracket 151 being shaped to include a pair of openings. A pin 153 is sized and shaped to be disposed through the openings in U-shaped bracket 151 and through an opening defined by hanger 87, thereby securing counterbalance 19 onto horizontal leg 75.

Counterbalance 19 is conventional in construction and includes a tether 155 which is wound within housing 149 and which includes a free end 157 disposed outside housing 149. As can be appreciated, free end 157 of tether 155 can be pulled away from housing 149. However, in the absence of the pulling force, tether 155 resiliently retracts free end 157 back towards housing 149, a stop 159 proximate free end 157 limiting the degree of retraction. A clip 161 is affixed onto free end 157 of tether 155 and is sized and shaped to releasably engage clip opening 29 in bracket 27.

As seen most clearly in FIG. 1, anvil 21 is mounted directly onto workstation W and serves to support the items to be coupled during the fastening process. Anvil 21 preferably comprises a support block and a plurality of filaments disposed into the support block. The support block is preferably constructed of polyvinyl chloride (PVC) and comprises a substantially flat top surface, a substantially flat bottom surface and four sidewalls. The support block has a length of approximately 4.0 inches, a width of approximately 4.0 inches and a thickness of approximately 0.75 inches. A plurality of openings are formed into the top surface of the support block and extend down a portion of the distance from the top surface towards the bottom surface. Each opening is generally circular in lateral cross-section with a diameter of approximately 0.098 inches. A tuft of nylon brush filaments is disposed into each opening to form anvil 21.

In use, system 10 can be used in the following manner to affix together two or more items using at least one individual plastic fastener from fastener stock 11. The items to be coupled together are placed on top of the filaments of anvil 21 which, in turn, is mounted on top of workstation W. The user then grasps handle 25 of module 15 and urges it downward so that the one or more needles 31 penetrate through the items to be coupled, said one or more needles 31 extending down between the filaments of anvil 21. It should be noted that counterbalance 19 enables module 15 to be easily handled by the user during high volume packaging operations, such as assembly line packaging, which is highly desirable.

With needle 31 disposed through the items to be coupled module 15 is actuated to eject a single fastener out through needle 31, thereby coupling together the desired items. The fastener dispensing process can be repeated as necessary. Upon completion of the fastener dispensing process, the user moves module 15 in the upward direction so that the one or more needles 31 retract from the items to be coupled. The coupled items are then removed from anvil 21, thereby completing the process for coupling together two items with one or more individual plastic fasteners.

Figure 4:
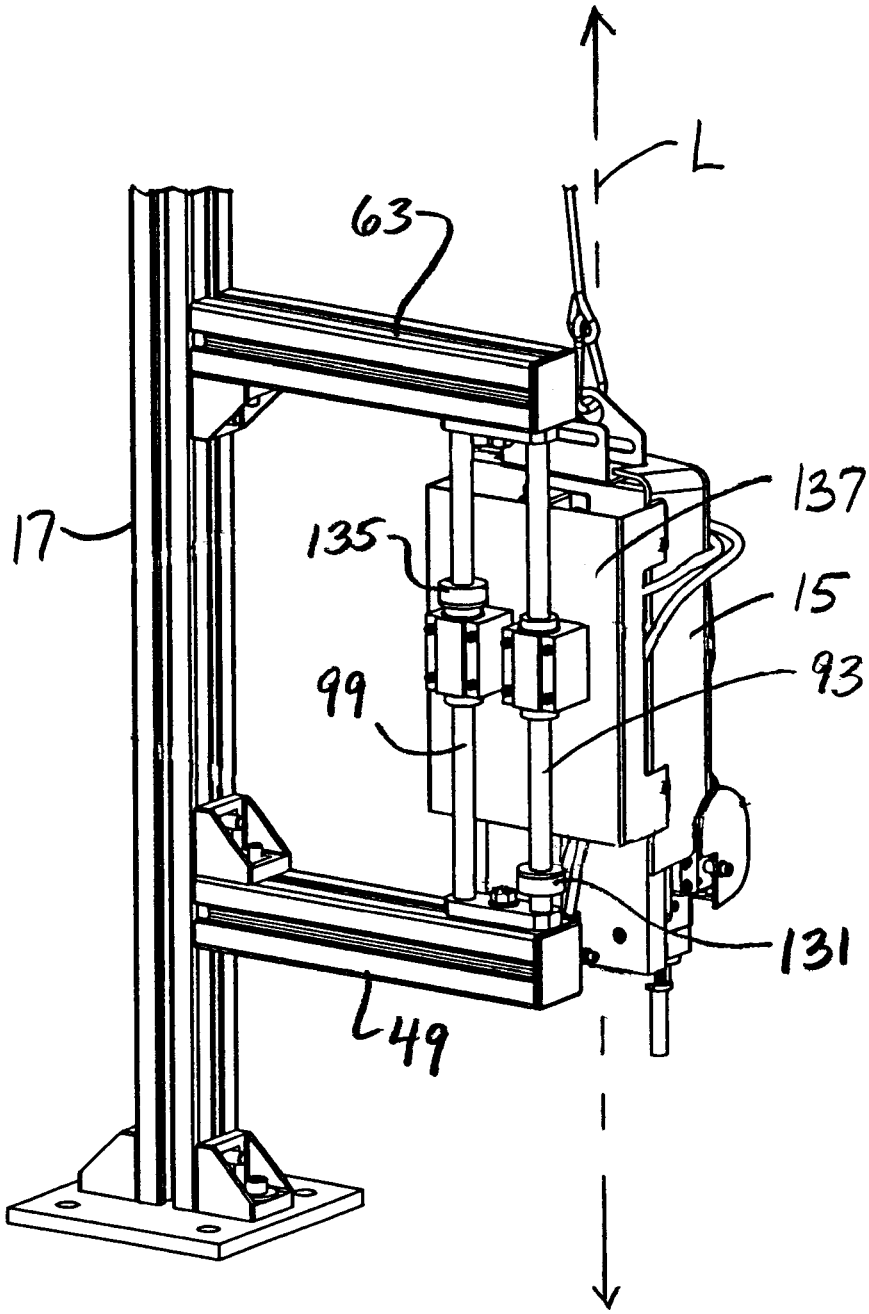
FIG. 4 is a rear, fragmentary, perspective view of the system shown in FIG. 1.

It should be noted that mounting stand 17 limits module 15 to linear displacement. Specifically, mounting stand 17 limits module 15 to vertical (i.e., straight up and down) displacement at an parallel to the Y-axis shown in FIG. 1. In particular, mounting stand 17 limits module 15 to linear displacement at an angle parallel with the longitudinal axes of shafts 93 and 99, module 15 traveling along the linear path defined by line L in FIG. 4. As can be appreciated, limiting module 15 to linear displacement along line L eliminates unnecessary forces on module 15 in the direction of the X-axis and/or the Z-axis. As a result, in those applications in which only vertical displacement is required (e.g., certain assembly line applications), mounting stand 17 helps to improve the efficiency of the movements which an operator will undertake when using module 15, which is highly desirable. In addition, in those applications in which only vertical displacement is required (e.g., certain assembly line applications), mounting stand 17 helps to improve the consistency of the location in which the one or more needles 31 of module 15 penetrate through successive groups of items to be coupled together, which is highly desirable.

It should also be noted that washers 129 and 133 and collars 131 and 135 serve to limit the range of the linear vertical movement of module 15 along line L. Specifically, together washer 129 and collar 131 serve as a stop for limiting the downward vertical movement of module 15. Similarly, together washer 133 and collar 135 serve as a stop for limiting the upward vertical movement of module 15. Furthermore, washer 129 and collar 131 could be repositioned along shaft 93 to adjust the range of acceptable downward displacement of module 15. Similarly, washer 133 and collar 135 could be repositioned along shaft 99 to adjust the range of acceptable upward displacement of module 15. As a result, because the range of vertical displacement of module 15 can be adjusted, the operator is limited to moving module 15 within an efficient range, which is highly desirable. In addition, because the range of vertical displacement of module 15 can be adjusted, the operator is precluded from over-inserting the needles 31 of module 15 through the items to be coupled, thereby protecting the needles 31 of module 15 and the items to be coupled from damage, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A system for dispensing a plastic fastener from a reel of fastener stock to couple together two or more objects, said system comprising:

(a) a module for dispensing the plastic fastener from the reel of fastener stock to couple together the two or more objects, said module comprising a housing, and (b) a mounting stand, said mounting stand comprising, (i) a vertical leg having a first end and a second end, (ii) a horizontal leg having a first end and a second end, said horizontal leg being fixedly coupled to said vertical leg at an approximate right angle, and (iii) a first shaft having a longitudinal axis, said shaft being fixedly coupled to said horizontal leg at an approximate right angle, said vertical leg and said shaft being disposed in a spaced apart, substantially parallel configuration, (c) wherein the housing for said module is slidably coupled to said shaft, said shaft limiting said module to linear displacement.

2. The system as claimed in claim 1 wherein said system is adapted to be mounted onto a surface having an X-axis and a Z-axis, said mounting stand limiting said module to displacement along a Y-axis which is perpendicular to the X-axis and the Z-axis.

3. The system as claimed in claim 1 wherein said module is limited to linear displacement at an angle parallel to the longitudinal axis of said shaft.

4. A system for dispensing a plastic fastener from a reel of fastener stock to couple together two or more objects, said system comprising:

(a) a module for dispensing the plastic fastener from the reel of fastener stock to couple together the two or more objects, said module comprising a housing, (b) a mounting stand onto which the housing for said module is coupled, said mounting stand limiting said module to linear displacement, said mounting stand comprising a first shaft, the first shaft having a longitudinal axis, and (c) a first linear ball bearing slidably mounted on the first shaft, (d) wherein the housing for said module is coupled to said first linear ball bearing, said module being limited to linear displacement at an angle parallel to the longitudinal axis of the first shaft.

5. The system as claimed in claim 4 wherein a first collar is slidably mounted on said first shaft, said first collar being adapted to be fixed in place on said first shaft so as to limit the range of linear displacement of said module in a first direction.

6. The system as claimed in claim 4 wherein a first bearing mount is fixedly coupled to said first linear ball bearing.

7. The system as claimed in claim 6 wherein a bracket is fixedly mounted onto said first bearing mount, said bracket being adapted to receive said module.

8. The system as claimed in claim 7 wherein said mounting stand comprises a second shaft which is disposed in a spaced apart, parallel relationship with said first shaft.

9. The system as claimed in claim 8 wherein a second linear ball bearing is slidably mounted on said second shaft.

10. The system as claimed in claim 9 wherein a second bearing mount is fixedly coupled to said second linear ball bearing.

11. The system as claimed in claim 10 wherein said bracket is fixedly mounted onto said second bearing mount.

12. The system as claimed in claim 11 wherein a first collar is slidably mounted on said first shaft, said first collar being adapted to be fixed in place on said first shaft so as to limit the range of linear displacement of said module in a first direction.

13. The system as claimed in claim 12 wherein a second collar is slidably mounted on said second shaft, said second collar being adapted to be fixed in place on said second shaft so as to limit the range of linear displacement of said module in a second direction, said second direction being opposite said first direction.

14. A system for dispensing a plastic fastener from a reel of fastener stock to couple together two or more objects, said system comprising:

(a) a module for dispensing the plastic fastener from the reel of fastener stock to couple together the two or more objects, said module comprising a housing, and (b) a mounting stand onto which the housing for said module is coupled, said mounting stand limiting said module to linear displacement, said mounting stand comprising, (i) a vertical leg, said vertical leg having a first end and a second end, (ii) a first horizontal leg having a first end and a second end, the second end of said first horizontal leg being affixed to said vertical leg, (iii) a second horizontal leg having a first end and a second end, the second end of said second horizontal leg being affixed to said vertical leg, each of said first and second horizontal legs extending generally orthogonally from said vertical leg, said first and second horizontal legs being disposed in a spaced apart, parallel relationship, (iv) a first shaft extending generally orthogonally between said first horizontal leg and said second horizontal leg, said first shaft having a longitudinal axis, and (iv) a third horizontal leg having a first end and a second end, the second end of said third horizontal leg being affixed to said vertical leg, and (c) wherein the housing for said module is slidably coupled to said first shaft, said module being limited to linear displacement at an angle parallel to the longitudinal axis of said first shaft.

15. The system as claimed in claim 14 wherein said third horizontal leg extends generally orthogonally from said vertical leg.

16. The system as claimed in claim 15 wherein a ring is mounted onto said third horizontal leg.

17. The system of claim 16 further comprising a counterbalance coupled to the ring on said third horizontal leg of said stand, said counterbalance supporting said module.

18. A system for dispensing a plastic fastener from the reel of fastener stock to couple together the two or more objects, said system comprising:

(a) a module for dispensing the plastic fastener from the reel of fastener from said reel of fastener stock to couple together the two or more objects, said module comprising a housing, (b) a mounting stand onto which said housing for said module is coupled, said mounting stand limiting said module to linear displacement, and (c) a counterbalance mounted onto said mounting stand, said counterbalance comprising a tether which includes a free end coupled to said module, said counterbalance supporting said module.

19. The system of claim 18 further comprising an anvil for supporting the two or more items to be coupled by the plastic fastener.

20. A system for dispensing a plastic fastener from a reel of fastener stock to couple together two or more objects, said system comprising:

(a) a module for dispensing the plastic fastener from the reel of fastener stock to couple together the two or more objects, said module comprising a housing, and (b) a mounting stand onto which the housing for said module is coupled, said mounting stand limiting said module to linear displacement, said mounting stand comprising a reel holder for holding the reel of fastener stock.

21. The system of claim 20 wherein said module further comprises a handle fixedly mounted onto the housing.

* * * * *